US005174346A

United States Patent [19]

Healy

[11] Patent Number: 5,174,346

[45] Date of Patent: Dec. 29, 1992

[54] FUEL DISPENSING NOZZLE

[75] Inventor: James W. Healy, Hollis, N.H.

[73] Assignee: Healy Systems, Inc., Hudson, N.H.

[21] Appl. No.: 706,807

[22] Filed: May 29, 1991

[51] Int. Cl.[5] ..... B67D 5/373

[52] U.S. Cl. ..... 141/226; 141/208; 141/206; 141/225; 141/302; 141/59

[58] Field of Search ..... 137/98; 141/206-229, 141/198, 392, 285, 295, 290-292, 296, 301, 302, 304, 305, 59

[56] References Cited

U.S. PATENT DOCUMENTS

| | | | |
|---|---|---|---|
| 413,355 | 1/1979 | Mayer | 141/217 |
| 1,998,221 | 4/1935 | Conklin | 141/225 |
| 3,323,560 | 6/1967 | Ehlers | 141/208 |
| 3,542,092 | 11/1970 | Budzak et al. | 141/209 |
| 3,548,893 | 12/1970 | Moore | 141/208 |
| 3,638,689 | 2/1972 | Eklund | 141/214 |
| 3,811,486 | 5/1974 | Wood | 141/208 |
| 3,982,571 | 9/1976 | Fenton et al. | 141/225 |
| 4,056,131 | 11/1977 | Healy | 141/206 |
| 4,057,086 | 11/1977 | Healy | 141/206 |
| 4,059,133 | 11/1977 | Hansel | 141/207 |
| 4,095,626 | 6/1978 | Healy | 141/206 |
| 4,121,635 | 10/1978 | Hansel | 141/207 |
| 4,258,760 | 3/1981 | Moore | 141/206 |
| 4,286,635 | 9/1981 | McMath | 141/98 |
| 4,336,830 | 6/1982 | Healy | 141/59 |
| 4,343,337 | 8/1982 | Healy | 141/226 |
| 4,372,353 | 2/1983 | Weas | 141/206 |
| 4,429,725 | 2/1984 | Walker et al. | 141/302 |
| 4,450,879 | 5/1984 | Wood | 141/209 |
| 4,497,350 | 2/1985 | Guertin | 141/206 |
| 4,809,753 | 3/1989 | Fink, Jr. | 141/206 |

FOREIGN PATENT DOCUMENTS

| | | | |
|---|---|---|---|
| 1097775 | 1/1961 | Fed. Rep. of Germany | 141/226 |

*Primary Examiner*—Henry J. Recla
*Assistant Examiner*—Casey Jacyna
*Attorney, Agent, or Firm*—Fish & Richardson

[57] ABSTRACT

An improved fuel dispensing nozzle of significantly reduced size and weight has a single diaphragm that provides the vapor regulating function as well as providing the excess pressure and excess vacuum shut-off functions. Improved shut-off function is obtained by ensuring that chamber pressure is the same as that at the spout tip disposed in the vehicle fuel tank fill pipe. The improved fuel dispensing nozzle design also reduces the amount of accidental fuel spillage which may occur when refueling is concluded.

17 Claims, 6 Drawing Sheets

FUEL DISPENSING NOZZLE

BACKGROUND OF THE INVENTION

The invention relates to fuel dispensing nozzles of the type described in my U.S. Pat. Nos. 4,056,131; 4,057,086 and 4,343,337; and in particular to those fuel dispensing nozzles having the feature of automatic shutoff.

It is known to provide a fuel dispensing nozzle that shuts off automatically when the tip of the spout is raised above its horizontal axis. One approach for achieve this objective is to provide an elongated chamber in the body of the nozzle, parallel with the horizontal axis of the nozzle. A ball is disposed inside the chamber and rolls backwards to actuate an automatic shutoff mechanism when the nozzle is raised above its horizontal axis.

It is also known to provide separate diaphragm assemblies for vapor regulation and high/low pressure sensing shutoff features. For example, Healy U.S. Pat No. 4,056,131 describes a vapor handling arrangement in which a vapor regulator valve closes when excess vacuum is applied. A simple diaphragm has one side exposed to the atmosphere and the other side exposed to a vapor conduit. Excess vacuum in the conduit draws the diaphragm onto its seat to close the valve. A second diaphragm disposed above the first is exposed to the Venturi effect of the fuel being dispensed. The second diaphragm shuts down the vacuum by constraining the first diaphragm when fuel is not being dispensed.

Healy U.S. Pat. No. 4,057,086 describes a vapor handling nozzle with a diaphragm. When the end of the nozzle spout becomes immersed in fuel, e.g. indicating that the vehicle fuel tank is full, vacuum generated by the Venturi effect of fuel delivered through a constrained passageway in the nozzle causes the diaphragm and an associated plunger to move upward to interrupt fuel delivery. Also, when vapor pressure in the fuel tank exceeds a predetermined level, the diaphragm and plunger are caused to move downward to interrupt fuel delivery.

Healy U.S. Pat. No. 4,343,377 describes a fuel dispensing nozzle with a pair of diaphragms that operate to interrupt flow when conditions of over-pressure or under-pressure exist.

SUMMARY OF THE INVENTION

The invention relates to a fuel dispensing nozzle for delivering fuel into a fuel tank by way of a fill pipe. The nozzle comprises a nozzle body, a spout housing, a spout extending from the spout housing, a fuel conduit defined by the nozzle and leading to the spout, a vapor conduit associated with the spout for withdrawing displaced vapors from the fuel tank being filled and transporting them to a remote vapor collection system, a fuel valve for controlling flow of fuel through the fuel conduit, an aspirator line having a tip located with respect to the spout so as to be in communication with the interior of the tank being filled when the spout is inserted in the fill pipe, means for producing a negative pressure in the aspirator line, pressure sensitive means in communication with the aspirator line for closing the fuel valve when a predetermined negative vent pressure condition exists in the aspirator line, an aspirator valve in the aspirator line between the tip and the means for producing a negative pressure in the aspirator line, pressure actuable means for controlling the aspirator valve, a vapor regulator valve in the vapor conduit operable in response to a predetermined first vapor pressure condition in the fuel tank, the vapor regulator valve comprising a diaphragm mounted in the nozzle with a first surface facing the vapor conduit, the diaphragm blocking the vapor conduit in a first position and not blocking the vapor conduit in a second position, and biasing means urging the diaphragm to the second position, the diaphragm having a second surface facing a chamber, the nozzle further defining a vent linking the chamber with the ambient exterior of the nozzle. According to one aspect of the invention, in an improved fuel dispensing nozzle, the pressure actuable means for controlling the aspirator valve is in communication with the vapor conduit, and the vapor regulator valve and the pressure actuable means comprise a single diaphragm, the pressure actuable means being arranged to respond to both positive and negative vapor pressure conditions in the vapor conduit and to close the aspirator valve when either of a predetermined second negative or positive vapor pressure condition is detected in the fuel tank being filled, thereby permitting the negative pressure in the aspirator line to reach the predetermined negative vent pressure value at the pressure sensitive means so as to actuate the pressure sensitive means to close the fuel valve.

Preferred embodiments of this aspect of the invention may include one or more of the following features. The vapor regulator valve further comprises a plug defining a vapor conduit orifice, and the diaphragm is adapted to move between a first position spaced from engagement with the plug and a second position in which the diaphragm is engaged with the plug in a manner to block the orifice. Preferably, the plug, in response to engagement by the diaphragm, is movable between a first position and a second position, and the nozzle further comprises biasing means urging the plug toward the first position. The biasing means for each of the diaphragm and the plug comprise a spring means, the spring means biasing the diaphragm having a lower biasing force than the biasing force of the spring means biasing the plug, whereby the absolute value of a predetermined first negative vapor pressure condition required for actuation of the vapor regulator valve to block the vapor conduit is less than the absolute value of a predetermined second negative vapor pressure condition required for actuation of the pressure actuable means. Preferably the predetermined first negative vapor pressure condition is of the order of ¼ inch W.C. below atmospheric. The aspirator valve comprises a valve housing and a valve member disposed for movement relative to the housing, and the spring means biasing the plug comprises a first spring element disposed between the valve housing and the valve member, and a second spring element disposed between the valve member and the plug. Preferably, the aspirator valve further comprises a first valve seat and a second valve seat, the pressure actuable means for controlling the aspirator valve being adapted, in response to the predetermined second negative vapor pressure condition to cause the valve member to engage upon the first valve seat in a manner to restrict flow in the aspirator line, and the pressure actuable means for controlling the aspirator valve being further adapted, in response to the predetermined positive vapor pressure condition to cause the valve member to engage upon the second valve seat in a manner to restrict flow in the aspirator line. More preferably, the predetermined second negative vapor pressure condition is of the order of 10 inches W.C. below atmospheric, and the predetermined positive vapor pressure condition is of the order of 10 inches W.C. above atmospheric. The nozzle further comprises a stem member connecting the diaphragm and the valve member, the valve member defines an axial cavity within which an end of the stem member is disposed, and the spring means biasing the diaphragm is disposed within the cavity about the end of the stem member. Preferably, the stem defines a collar and the spring means biasing the diaphragm is engaged between the valve member and a surface of the collar. The valve member defines an annular flange and the first and second springs for biasing the plug engage upon surfaces of the flange, preferably the valve member further comprises a cap, and the cap defines the flange.

According to another aspect of the invention, in a fuel dispensing nozzle, the pressure sensitive means comprises a diaphragm having a first surface facing a aspirator line chamber in communication with the aspirator line and a second surface facing a vapor return line chamber in communication with the vapor return line in a manner whereby the pressure in the vapor return line chamber is generally the same as the pressure at the tip of the spout in the fill pipe of the vehicle fuel tank.

In a preferred embodiment of this aspect of the invention, and according to another aspect of the invention, in a fuel dispensing nozzle, a bore is defined by the spout housing and intersects the aspirator line, the bore, when the spout is disposed in a predetermined position for delivery of fuel into the fuel tank fill pipe, having an axis which is inclined downwardly from the intersection of the bore and the aspirator line, the nozzle further comprises a valve element disposed in the bore, the valve element being adapted to move between a first position with the valve element spaced from the intersection of the bore and the aspirator line in a manner to allow vacuum to be drawn through the aspirator line from the spout and a second position with the valve element disposed at the intersection of the bore and the aspirator line in a manner to block the drawing of vacuum through the vapor conduit from the spout, thereby to actuate the pressure sensitive means to cause the fuel valve to close ceasing flow of fuel to the spout.

Preferred embodiments of this embodiment and/or aspect of the invention may include one or more of the following features. The valve element is a spherical element disposed within the bore, the spherical element being sized relative to the bore to permit the spherical element to roll between the first position and the second position, and the spherical element being sized relative to the aspirator line to block vacuum flow from the spout through the aspirator line when spherical element is in the second position. Preferably, the axis of the bore is downwardly inclined at about 30° to the horizontal axis when the nozzle is disposed in a predetermined position for delivery of fuel into the fuel tank fill pipe.

The invention thus provides a fuel dispensing nozzle of reduced size and weight, achieved by combining structural features for performance of required operation. The fuel dispensing nozzle of the invention also provides for conservation of fuel and protection of the environment by reduction of the volume of accidental spillage, and for safer operation by automatically discontinuing fuel delivery whenever at least one of a number of pre-defined conditions are present. These conditions include: presence of fuel detected at spout outlet (tank full condition); disposition of the nozzle at an inclined angle above a prescribed limit (nozzle spout removed from fuel tank condition); variation in vacuum pressure beyond defined limits; and improved sensing of out of limit high pressure and low pressure conditions relative to pressure at the vent inlet.

Other features and advantages of the invention will be seen from the following description of a presently preferred embodiment, and from the claims.

BRIEF DESCRIPTION OF THE DRAWINGS

FIG. 4 is an enlarged end sectional view of the body of the fuel dispensing nozzle of FIG. 1, taken at the line 4—4 of FIG. 3, showing a vacuum regulation and positive/negative pressure sensing shut-off assembly, while

DESCRIPTION OF A PRESENTLY PREFERRED EMBODIMENT

Reference will be made throughout to my prior patents, U.S. Pat. No. 4,343,337 (issued Aug. 10, 1982); U.S. Pat. No. 4,056,131 (issued Nov. 1, 1977 ) and U.S. Pat. No. 4,057,086 (issued Nov. 8, 1977), the disclosures of which are incorporated herein by reference.

Figure 1:
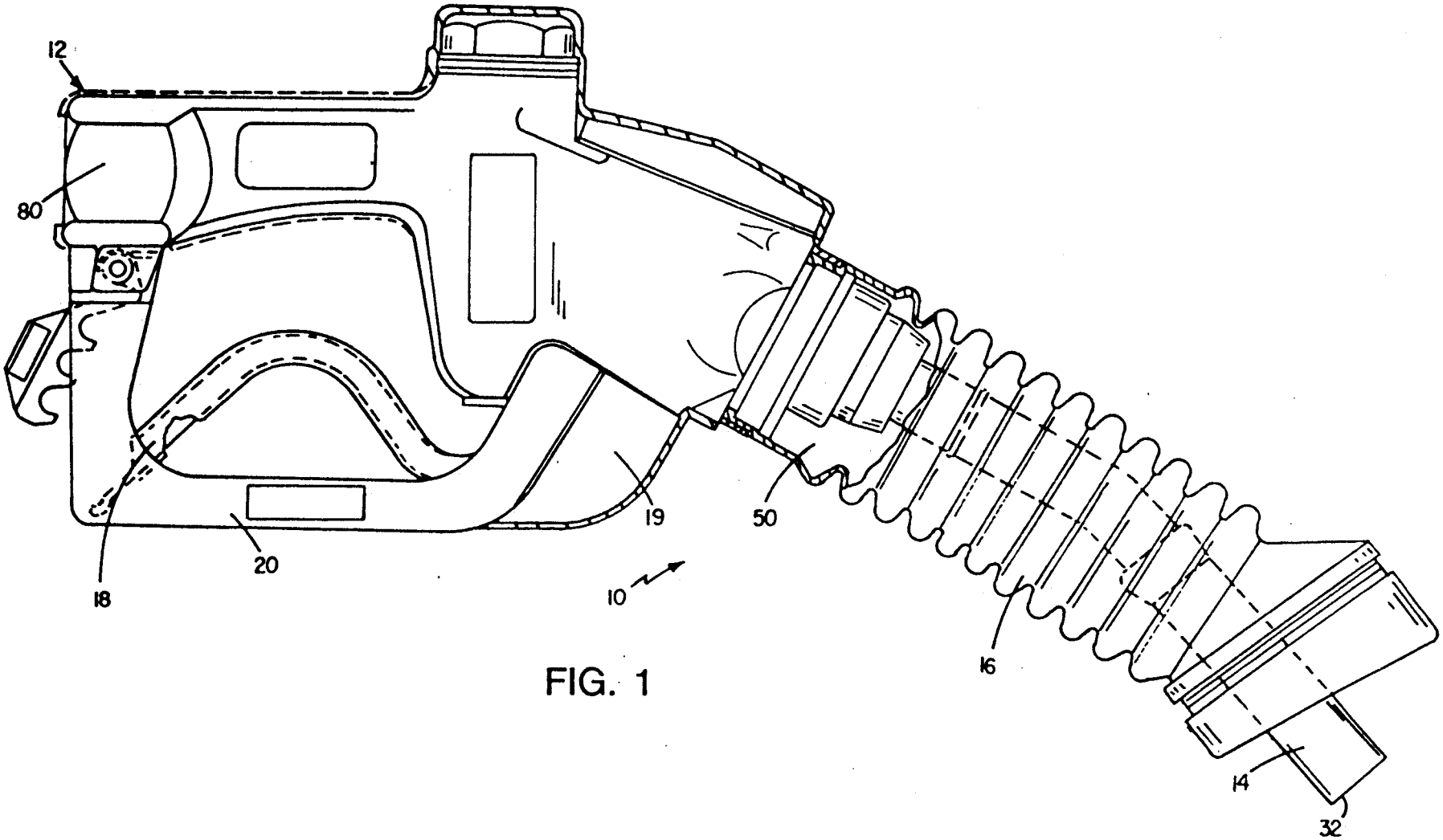
FIG. 1 is a side plan view of a fuel dispensing nozzle of the invention.

Referring now to FIG. 1 of the present application, a fuel dispensing nozzle 10 of the invention consists of a nozzle body 12, formed, e.g., of aluminum, to which there is joined a spout assembly 14 (FIG. 1A) for delivery of fuel into a vehicle tank (not shown). A boot assembly 16 (FIG. 1B) disposed about the nozzle is adapted for collection of fumes displaced from the tank by fuel, as will be described in more detail below. A lever assembly 18 for operation of nozzle is disposed beneath the nozzle body, within the region defined by hand guard 20.

Figure 1A:
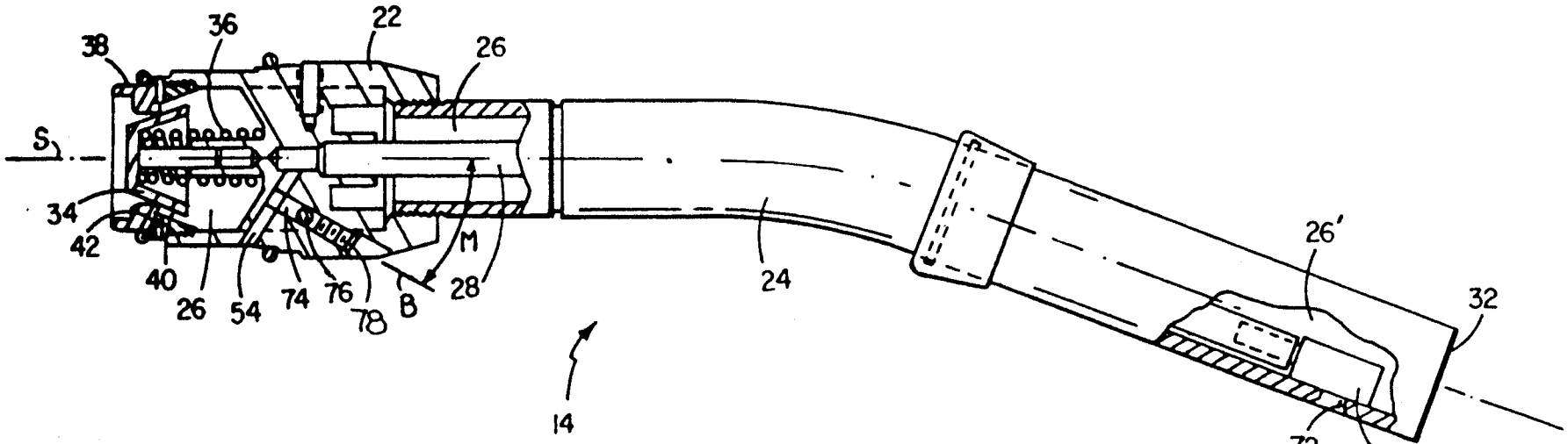
FIG. 1A is a side view, partially in section, of the spout assembly of the fuel dispensing nozzle of FIG. 1.

Referring now to FIG. 1A, the spout assembly 14 includes a spout housing 22 and a spout tube 24 joined to the spout housing in threaded engagement, together defining a conduit 26, 26' for delivery of fuel from the nozzle body into a fuel tank. A vent tube 28, the function of which will be described more fully below, extends within the conduit portion 26' defined by the spout tube 24, from a vent tube connector 30 adjacent the tip 32 of the spout tube to attachment at the spout housing 22. A check valve element 34 is disposed within the chamber portion 26 of the conduit defined by the spout housing 22, urged by compression spring 36 into sealing engagement with a seat surface 38 supported by the spout housing in a manner to prevent reverse flow of fuel from the spout assembly into the nozzle body. The fuel passage 40 defined by the check valve element 34 and the surrounding surfaces of the spout housing are configured in a manner to cause fuel flowing through the narrow passageway to create a Venturi effect in order to generate a vacuum that is drawn through vent passageway 42, as will be described more fully below.

Figure 1B:
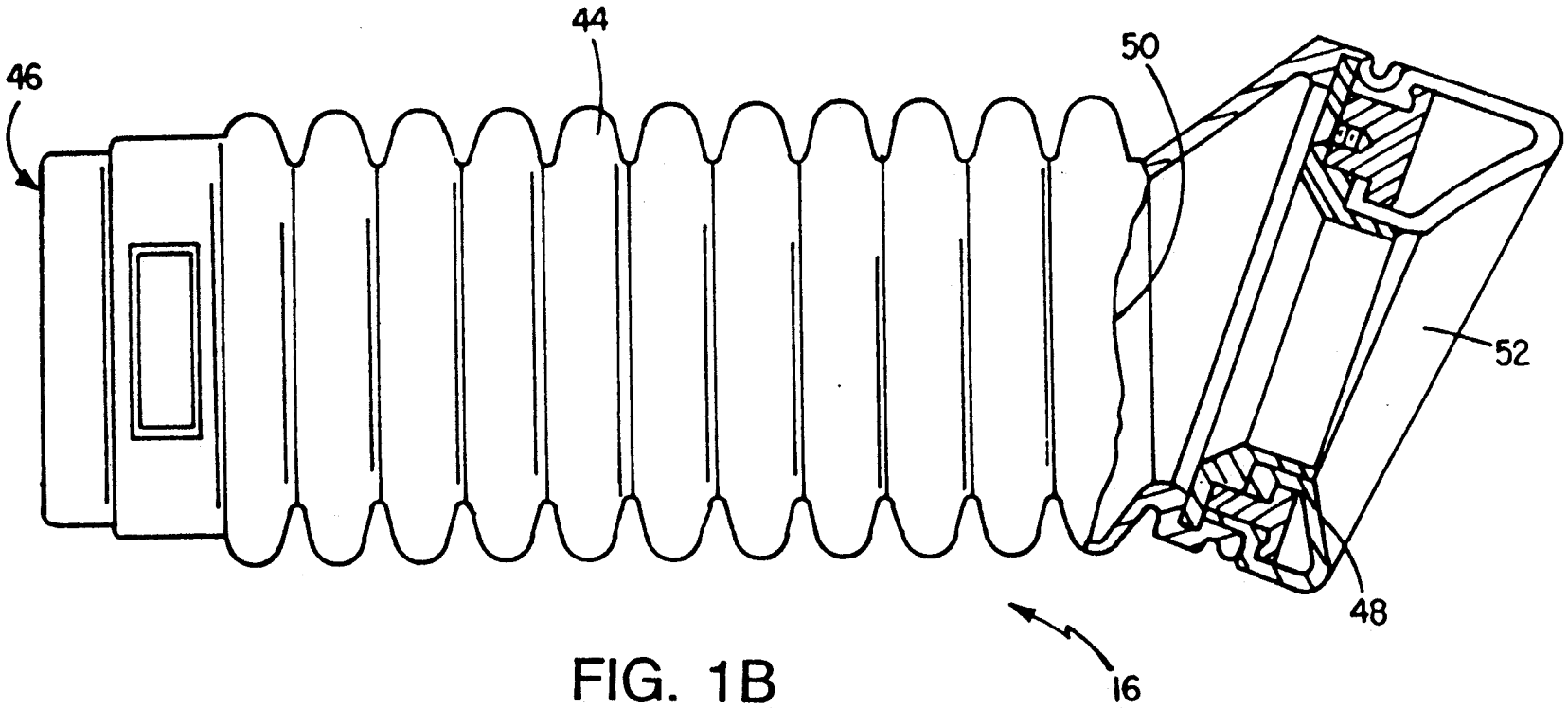
FIG. 1B is a side view, partially in section, of the boot assembly of the fuel dispensing nozzle of FIG. 1.

Referring now to FIG. 1B, the boot assembly 16 consists of an elongated tubular element 44 having a first (inner) end 46 joined in sealed engagement to the nozzle housing 12 adjacent the inner end of the spout assembly 14, and a second (outer) end 48 spaced about the end 32 of the spout tube 24. The boot element 44 defines a chamber 50 about the spout assembly 14, with the surface 52 of the open outer end 48 of the boot sized and adapted to be placed in sealing engagement with a surface surrounding the opening of a vehicle tank fill pipe in order to contain fumes displaced from the vehicle tank by the entering fuel.

Figure 2:
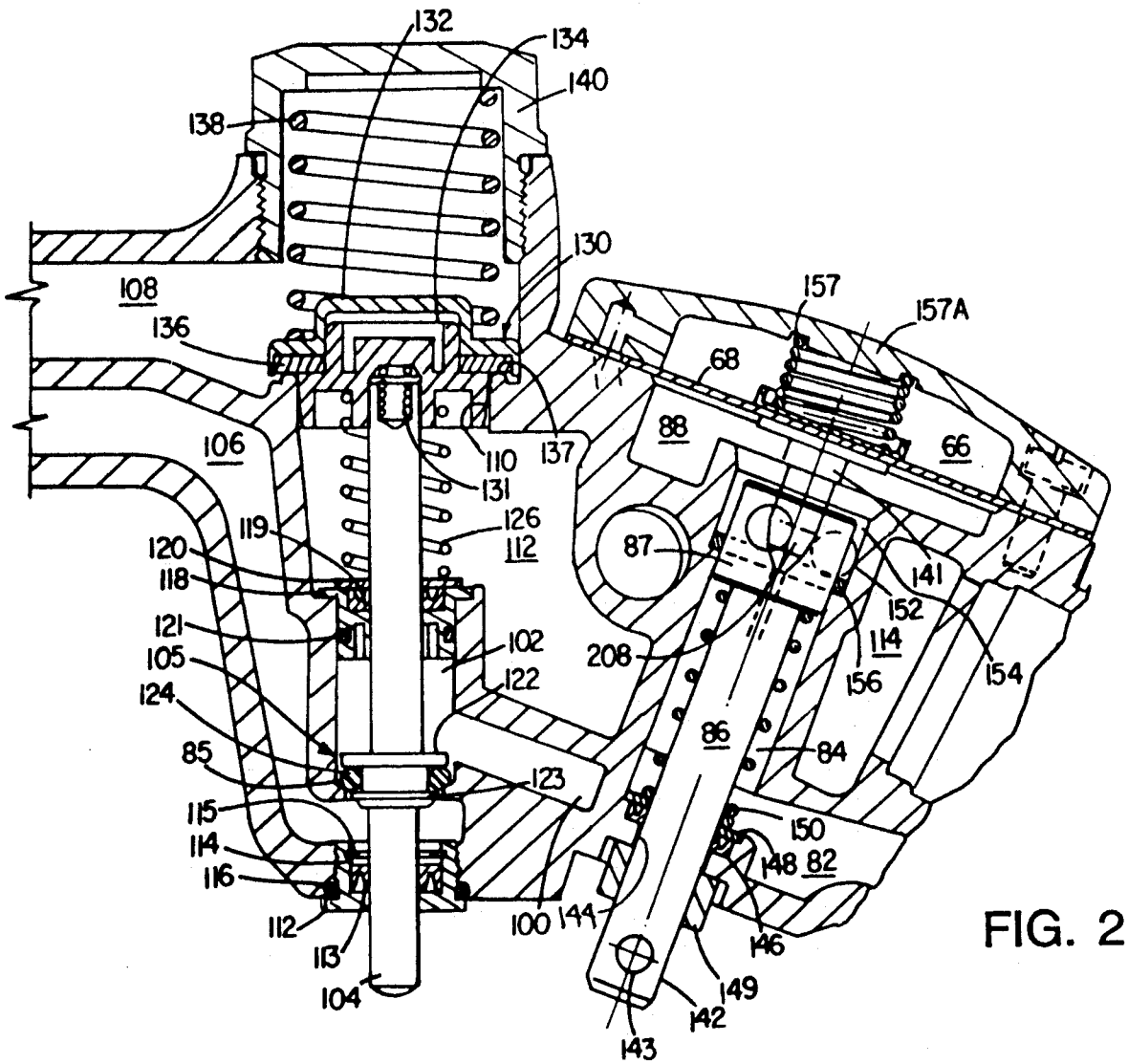
FIG. 2 is an enlarged side sectional view of the body of the fuel dispensing nozzle of FIG. 1.

Referring now also to FIGS. 1A and 2, at its inner end, the vent conduit defined by the vent tube 28 connects to a vent passageway 54 defined by the spout housing 22, which in turn connects sequentially to vent passageways 56, 58 and 60 (FIG. 3), which are defined by the nozzle body 12. (Referring to FIG. 3, vent passageway 58 is an extension of drill path 310, which has an outlet 311 beneath the peripheral rim of cover 157A, sealed by diaphragm 68; vent passageway 60 is sealed by set screw. Passageway 60 terminates at chamber 160 (FIG. 4), described in more detail below. The vent conduit continued into chambers 161 and 163 about valve stem 162, then exits from chamber 163 via two outlets 163A defined in valve housing 158 into chamber 163B. The vent conduit next continues in passageway 62 via an inlet from chamber 163B into chamber 66, defined in part by diaphragm 68. Return vent passageway 70 connects chamber 66 to vent passageway 42, defined by the spout housing 22 and terminating at fuel passage 40, in the region of check valve element 34. In this manner, a closed circuit is established for vacuum generated by the Venturi effect of fuel flowing through fuel passage 40 through passageways and chambers 70, 66, 62, 163B, 163A, 163, 161, 160, 60, 58, 56, 54, through vent tube 28 from inlet 72 from vent tube connector 30 at the end region of the spout 24 (i.e., an aspirator line).

In nozzles of prior known design, a check valve mechanism is provided in the body of the nozzle, relatively remote from the spout outlet. When the check valve mechanism is triggered, a significant volume of fuel is contained within the nozzle. As a result, if the nozzle is not tipped forward into the fuel tank to drain the residual fuel from the nozzle, the residual fuel may be spilled when the end of the nozzle is removed from the vehicle fill pipe, thus damaging the vehicle finish, creating a danger of explosion, and polluting the environment.

In the fuel dispensing nozzle 10 of the invention, in order to reduce the amount of fuel that might accidentally be dispensed from the nozzle, e.g., as sometimes occurs when a user removes and returns the nozzle to the fuel pump, there is provided an improved flow stop mechanism. Referring to FIG. 1A, the spout housing 22 defines a further cylindrical passageway 74 intersecting passageway 54 and extending at a downward angle disposed at an angle M, e.g. approximately 30°, to the axis S of the spout housing 22, lying generally horizontal when the nozzle 10 is in its normal, predetermined position for filling a fuel tank. A spherical element 76 is disposed for movement within the cylindrical passageway 74, the outer end of which is accessed via a threaded set screw 78 for ease of maintenance. The spherical element 76 is sized relative to the diameter of passageway 74 so that it readily rolls when the axial orientation of the spout housing 22 is changed, and is further sized so that when the element is lodged at the intersection of passageway 74 with passageway 54, vacuum flow from the inlet 72 toward chamber 66 et seq. is interrupted. When the nozzle 10 is disposed in an orientation for dispensing fuel, e.g. with the angle the spout housing axis S to the horizontal no less than about 0°, the spherical element 66 is disposed toward the outer end of passageway 74, away from the intersection with passageway 54, and the vacuum passageway is unobstructed. However, when the nozzle is reoriented to a position in which the angle of the axis B of the passageway 74 is greater than 0° to the horizontal, e.g., when the nozzle is carried upright to the fuel tank or hung on the fuel pump, gravity causes the spherical element 76 to roll into the intersection with passageway 54, blocking vacuum flow from the inlet 72, thereby simulating a fuel tank full condition and thus cause the fuel dispensing nozzle to discontinue fuel flow by raising the level of vacuum in chamber 66, as will be described in more detail below. When the nozzle 10 is returned towards its original orientation, i.e. with axis B inclined downward at an angle greater than 0° to the horizontal, the element 76 rolls away from the passageway intersection, thus allowing reestablishment of flow from inlet 72 adjacent the spout tip in order to reduce the level of vacuum in chamber 66 to below a predetermined maximum level.

Figure 3:
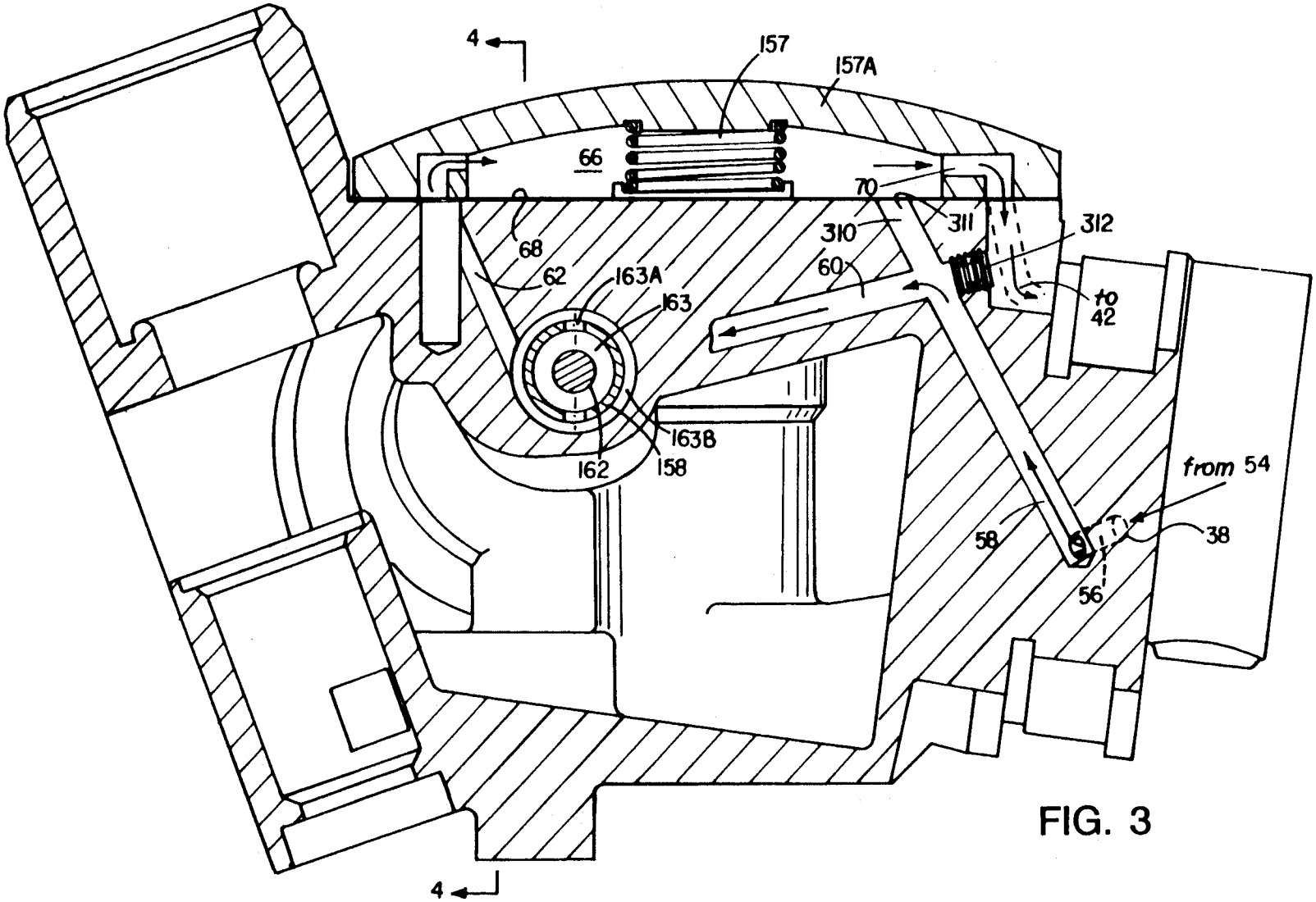
FIG. 3 is an enlarged side sectional view of the body of the fuel dispensing nozzle of FIG. 1, taken at the line 3—3 of FIG. 4.

Referring now to FIG. 1 in combination with FIGS. 2, 3 and 4, the structure of the fuel dispensing nozzle 10 of the invention will now be described.

The body 12 of the fuel dispensing nozzle 10 is adapted for connection at 80 to a hose (not shown) defining a first conduit for connection of the nozzle to an external source of fuel and a second, typically coaxial conduit for connecting the nozzle to an external source of vacuum (not shown).

Referring to FIGS. 1 and IB, fuel vapors displaced from the vehicle fuel tank by entering fuel are drawn into the open end 52 of the boot element 44 disposed about the spout tube 24 by action of the external vacuum source, as will now be described. The region 50 within the boot element is connected to passageway 82, defined by the nozzle body 12. The vapors are drawn from passageway 82 into passageway 84 containing plunger 86, the passageway 84 being connected to chamber 88, which is defined in part by diaphragm 68. Vapor in passageway 84 is drawn via a connecting passageway (not shown) into chamber 90, which is defined in part by orifice plug 92 and diaphragm 94. The vapor is drawn from chamber 90 via the orifice 93 defined by orifice plug 92, into chamber 96 and then into passageway 98. Referring also to FIG. 2, passageway 98 is connected to passageway 100 which terminates at chamber 102, through which there extends valve stem 104. When the nozzle is actuated, vapor is drawn from chamber 102, through vapor valve 105 and into passageway 106 which is connected via a hose (not shown) to the external vacuum source (also not shown).

Referring still to FIG. 2, the nozzle body 12 defines passageway 108 for delivery of fuel received via the fuel line in the hose. When the nozzle is actuated, fuel passes through valve opening 110, and then via passageways 112, 114 to the spout assembly 14. As described above, and with reference to FIG. 1A, the fuel passes through passageway 40 between the check valve element 34 and the surrounding wall of the spout housing 22 to create a vacuum in passageway 42. The fuel travels through chamber portion 26 and then via conduit 26' of the spout tube 24 to be delivered in the vehicle fuel tank.

Referring again to FIG. 2, the main valve assembly 130 consists of a valve stem 104 mounted for axial movement within the nozzle body relative to the fixedly mounted stem seal body 112 and stem seal insert 118. Stem seal body 112 is disposed in threaded engagement with the nozzle body and defines an axial opening through which the valve stem 104 extends. Vacuum tight seal between the valve stem 104 and the stem seal body 112 is maintained by means of a u-cup seal 113, held in place by stem seal washer 114 and retaining ring 115. Vacuum tight seal between the stem seal body 112 and the nozzle body 12 is facilitated by o-ring 116. Stem seal insert 118, disposed in press fit engagement with the nozzle body 12, also defines an axial opening through which the valve stem 104 extends. A leak-tight seal between the valve stem and the stem seal insert 118 is maintained by use of a u-cup seal 119, held in place by spring 12 disposed under compression to bear upon support washer 120. The seal between the stem seal insert 118 and the nozzle body 12 is facilitated by o-ring 121.

The valve stem 104 defines a vacuum valve 105 consisting of a pair of spaced apart annular flanges 122, 123, between which is disposed a vacuum valve element 124, e.g. an o-ring, sized for sealing engagement upon valve seat 85.

The main fuel valve assembly 130 is mounted upon the upper end of valve stem 104 by means of valve stem compression spring 131, and includes a main valve cap 132 and a poppet skirt 134. A main valve seal 136 is disposed between the cap 132 and skirt 134, and main spring 138, held in place by body cap 140, bears upon the valve cap 132 in a manner to maintain the seal 136 in sealing engagement upon valve seat 137 defined by the nozzle body 12. As described more fully below, the nozzle is constructed in a manner whereby actuation of the nozzle by upward axial displacement of the valve stem 104 causes the vacuum valve to be opened and vacuum established in the passageways of the nozzle before the valve 130 is actuated for flow of fuel.

Referring still to FIG. 2, plunger 86 disposed in vapor passageway 84 has an enlarged plunger head 87 surrounding latch pin 141 attached to diaphragm assembly 68, and an outer end 142 which extends through orifice 144 in the nozzle body 12, the orifice being sealed by u-cup seal 146, held in place by washer or u-cup retainer 148. A plunger latch spring 150 is disposed between the washer 148 and the enlarged head portion 87 of plunger 86. A spacer 149 is disposed about the lower end 142 of the plunger 86, external of the nozzle body. Three balls 152 are disposed in the chamber 154 defined about the plunger head portion 87, maintained in the position shown in the FIGURE by means of latch ring 156 and latch pin 141. The position of the plunger 86 and the diaphragm assembly at rest are further maintained by diaphragm spring 157 disposed in chamber 66 between the diaphragm and cover 157A. Referring also to FIG. 1, the lever assembly 18 for actuation of the nozzle (described below) is pivotally connected to the end 142 of the plunger 86 by means of lever pin 19 disposed in plunger orifice 143.

Figure 4:
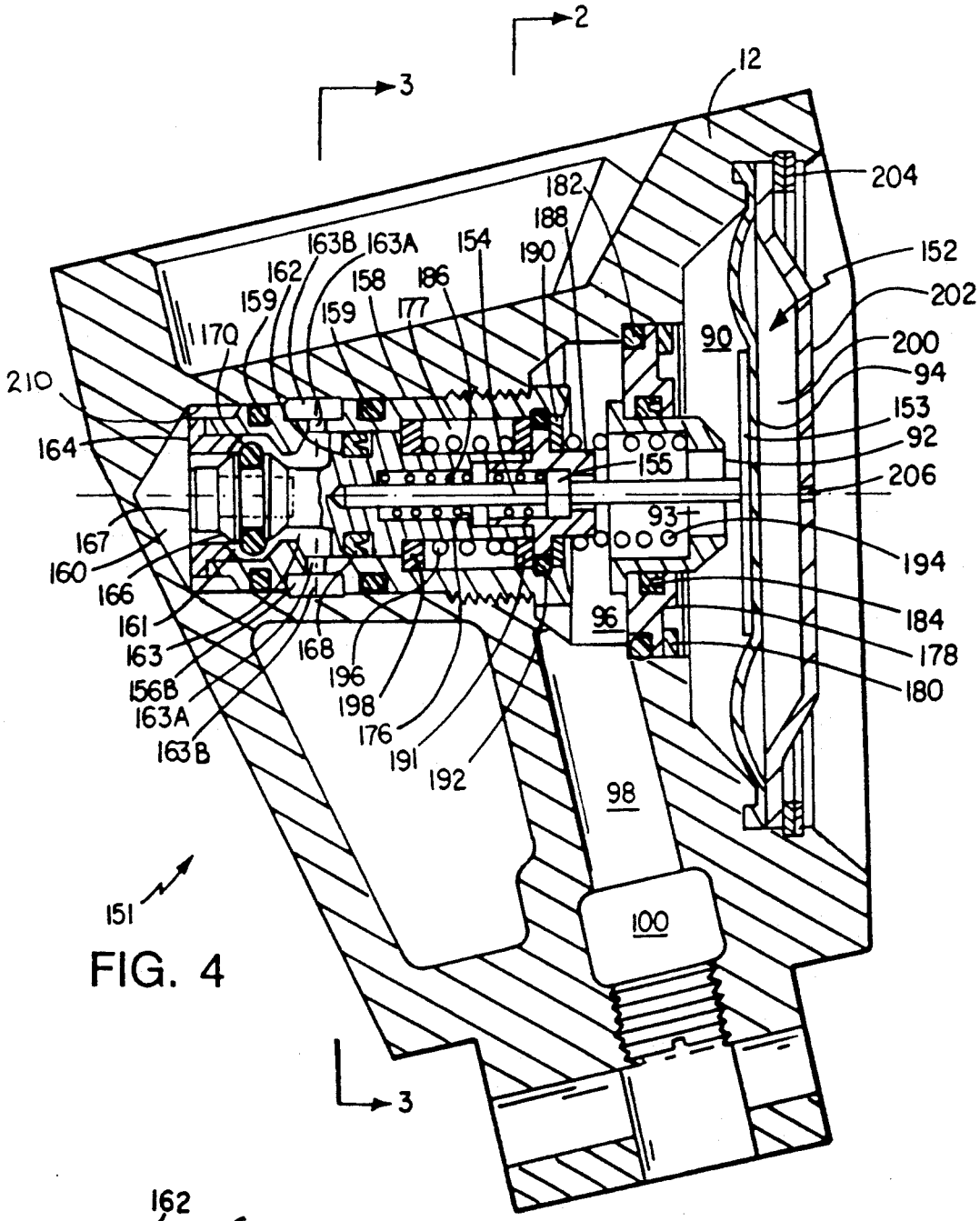
Figure 4A:
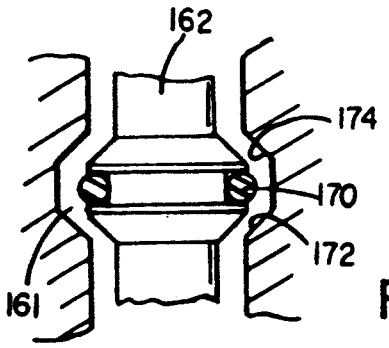
FIG. 4A is an enlarged view of the valve element of the assembly of FIG. 4.

Referring now to FIG. 4, there is shown a vacuum regulation and positive/negative pressure sensing shut-off assembly 151, including a single vapor pressure regulation diaphragm assembly 152. The diaphragm assembly includes diaphragm 94 with an attached stiffener plate 153, and a diaphragm regulation stem 154 attached to the plate in threaded engagement. The nozzle body 12 defines a generally cylindrical bore 210 within which there is disposed a valve housing 158 in threaded engagement with the nozzle body. A chamber 160, defined at the inner tip of bore 210, lies in serial communication with chambers 161, 163 defined by the valve housing. Outlets 163A defined through the valve housing provide communication between chamber 163 and a further chamber 163B defined between the wall of the cylindrical bore and the valve housing. A valve seat 164 also defined by the inner surface of the valve housing is disposed within chamber 161. A valve stem 162 is disposed within the housing for axial movement generally within the chamber 161, with the end of the valve stem in sliding engagement with a valve stem retainer 166 fixedly mounted by screw 167 at the base end of the bore 210. The chambers 163, 163B are sealed by means of o-rings 159 disposed between the valve housing 158 and the wall of the bore 210 and by u-cup seal 168 mounted upon the valve stem 162, and are in communication with passageway 62, as shown in FIG. 3. Passageway 60 is in communication with chamber 160, sealed by o-ring 159. As mentioned above, chambers 160 and 163 are in communication via chamber 161. Referring also to FIG. 4A, an o-ring 170 mounted about the valve stem 162 within the region of chamber 161 is sized and adapted in a first axial position of the valve stem 162 to bear in sealing engagement upon valve seat 172 and in a second axial position of the valve stem 162 to bear in sealing engagement upon valve seat 174, as will be described more fully below.

Referring again to FIG. 4, the diaphragm regulation stem 154 extends through the orifice 93 defined by orifice plug 92 into an axial cavity 176 defined by the valve stem 162. The orifice plug 92 is mounted for axial movement in orifice plug retainer 178, which is held in place by retaining ring 180, with sealing provided by o-ring 182, disposed between the fixed surfaces of plug retainer 178 and the nozzle body 12, and by u-cup seal 184, disposed between slidingly engaged surfaces of the plug 92 and the plug retainer 178. A pressure regulation spring 186 is disposed about the diaphragm regulation stem 154 within the cavity 176 of the valve stem 162, and bears upon the undersurface of a collar 155 of the stem 154. The upper surface of the collar 155 engages upon valve stem cap 188, which has an outer annular flange disposed between washers 190, 191. An o-ring 192 is also disposed between washers 190, 191. A first positive/negative shut-off spring 194 is engaged under compression between orifice plug 92 and washer 190, and a second positive/negative shut-off spring 196 is engaged under compression within the cavity 177, between washer 191 and washer 198. A second chamber 200 is defined by diaphragm 94 in combination with diaphragm regulation cover 202, retained by retainer ring 204.

Referring now again to FIG. 1 et seq., for dispensing fuel, the spout 14 of a fuel nozzle 10 of the invention is inserted into the fill pipe of a vehicle fuel tank, bringing the surface 52 of the open outer end 48 of the boot assembly 16 into sealing engagement with a surface about the fill pipe.

The fuel nozzle 10 is actuated by moving operating lever 18 toward the nozzle housing 12, causing the inner end of the lever to pivot about lever pin 19 in the end orifice 143 in the end 142 of plunger 86. The lever 18 engages the exposed end of the valve stem 104, raising the stem to open vapor vacuum valve 105 by lifting o-ring 124 from seat 85 to allow the remote vacuum pump (not shown) to draw vacuum and evacuate vapor from vapor passageway 100 et seq. Further upward movement of lever 18, and thus valve stem 104, causes spring 131 to compress without opening the fuel valve 130. As further pressure is applied to lever 18, the compression force of spring 138 is overcome, and fuel valve 130 is opened to allow fuel to flow from a remote fuel pump (not shown) through the passageways 108, 112, et seq., to exit from the spout 24 via conduit 26, 26'.

When fuel is delivered from spout 24 into a vehicle tank, vapor displaced from the vehicle fuel tank enters the boot or bellows assembly 16 and is drawn through region 50 into passageway 82 defined by the nozzle body 12, then upward through vapor passageway 84, housing plunger 86. Vapor in passageway 84 is drawn via a connecting passageway (not shown) into chamber 90, which is defined in part by orifice plug 92 and diaphragm 94. Diaphragm 94 is biased to the position shown by compression spring 186. When pressure within chamber 90 is reduced ¼ inch W.C. below atmospheric pressure by the action of the remote vacuum pump, the pressure differential between chamber 90 and chamber 200, which is open to the atmosphere via port 206, will cause diaphragm 94 to overcome the resisting force of compression spring 186 and engage upon the surface of orifice plug 92, thus closing off the orifice 93. When the vapor pressure rises back towards atmospheric pressure, the diaphragm 94 moves away from the orifice 93 and allows vapor to be once again evacuated from chamber 90. The vapor is drawn from chamber 90 via the orifice 93 into chamber 96 and then into passageway 98. Referring also to FIG. 2, passageway 98 is connected to rectangular passageway 100 which terminates at chamber 102 leading to the vapor shut-off valve 105. The valve 105 is opened by the action of raising lever 18, which lifts valve stem 104 to unseal o-ring 124 from valve seat 85. As described above, continued movement of the valve stem 104 will compress spring 131 and contact the fuel valve 130, to raise seal 136 from the valve seat 137 to permit gasoline flow. When the vapor valve 105 is in open position, the remote vacuum pump will draw vapor through the valve opening and then upward into passageway 106 within the nozzle handle, and then finally into a central conduit of the coaxial hose assembly (not shown).

The diaphragm 94 also acts to provide automatic nozzle shut-off under conditions of excess positive or negative pressure. If vapor pressure within chamber 90 reaches +10 inches W.C., the diaphragm 94 is caused to overcome the combined compressive force of spring 194 and spring 196. Excess positive pressure at +10 inches W.C. acting on diaphragm 94 with attached stiffener plate 153 will act to exert a pulling force on the diaphragm regulation stem 154. The stem 154 in turn exerts a pulling force against the valve stem cap 188 which is in fixed threaded engagement with valve stem 162. The cap 188 and the valve stem 162 have narrow flange extensions which are in contact with separate washers 191, 192 and 198, respectively. These washers engage the two compression springs 194 and 196. The force developed by +10 inches W.C. acting on diaphragm 94 will begin to compress the springs further, thus causing the valve stem 162 to move towards a position in which the o-ring 170 bears in sealing engagement upon the valve seat 174 (FIG. 4A). When the o-ring seals upon the valve seat 174, the flow of vapor from passageway 60 to passageway 62 is effectively blocked, thus causing the aspirator vacuum level to increase rapidly in chamber 66 (FIG. 2), causing the nozzle to shut off (see, e.g., U.S. Pat. No. 4,343,337, col. 4, line 58 through col. 5, line 2).

Excess negative pressure at −10 inches W.C. acting on diaphragm 94 will cause the diaphragm to push on the stem 154, causing it to move into contact with the valve stem 162 at the same time the diaphragm 94 comes into contact with the orifice plug 92. At this point, further movement of the diaphragm and stem will cause the orifice plug 92 to compress spring 194 while at the same time the valve stem cap flange engages the second spring 196 by pushing on washer 191, thus causing the valve stem 162 to move towards a position in which the o-ring 170 bears in sealing engagement upon the valve seat 172 (FIG. 4A). When the o-ring seals upon the valve seat 172, the flow of vapor from passageway 60 to passageway 62 is effectively blocked, thus causing the aspirator vacuum level to increase rapidly in chamber 66 (FIG. 2), causing the nozzle to shut off, as described above with reference to excess positive pressure automatic shut-off.

Nozzle shut-off is accomplished by vacuum acting on diaphragm 68 which acts to overcome the downward force of spring 157 and the frictional drag of the stainless steel balls 152 against the pin 208 at a vacuum of approximately 25 inches W.C. (see, e.g., U.S. Pat. No. 4,343,337, col. 4, line 58 through col. 5, line 2). A more reliable shut-off function will occur when the pressure in chamber 88 is the same as the pressure at the tip 32 of nozzle spout 14. Since the boot assembly 16 seals the fill pipe surrounding the spout tip, pressure may vary from atmospheric depending on the vapor pressure control provided by the vacuum pump and vapor pressure regulating diaphragm 94. By providing an open connection between passage 84 and chamber 88, it can be ensured that the aspirator circuit will produce a vacuum differential across the shutoff diaphragm 68 in a consistent fashion between +10 inches W.C. in the fill pipe, since the vent inlet pressure and the pressure in chamber 88 will be identical.

Referring again to Figs. 1 and 2, if the vent circuit is blocked, e.g. by presence of the spherical element 76 at the intersection of bore 74 with passageway 54, or a full tank condition in which fuel is present at the inlet 72 of connector 30, fuel nonetheless continues to flow into the nozzle and the vacuum pressure in the chamber 66 increases rapidly. In response, the diaphragm 68 moves upwardly, overcoming the downward force of spring 157, and also drawing pin 208 upwardly. As the pin is moved upward, the wider upper portion of the pin is removed from adjacent balls 152, leaving the narrower, lower portion of the pin adjacent the position of the balls. This permits the balls 92 to pass downward, by the latch ring 156. This releases the plunger to move downwardly and release the end of lever 18. Since the lever 18 no longer holds the valve stem 104 in place, spring 138 forces the valve stem downward and closes the fuel valve 130, and spring 131 closes the vapor valve 105, thereby shutting off the nozzle.

As described, the present invention further improves on previously known nozzles by combining the mechanisms for achieving the vapor regulation and high/low pressure sensing features (described in detail in my patents, U.S. Pat. No. 4,056,131 and U.S. Pat. No. 4,343,337), thereby reducing the overall size and weight of the nozzle.

Furthermore, the present invention, in using a single diaphragm assembly for vapor regulation and high/low pressure sensing, eliminates the need for a second diaphragm assembly and its associated sensing chamber and atmospheric reference chambers. The nozzle of the present invention, therefore, is smaller in size and weight than previously known nozzles, thereby making it easier to handle during refueling. The present invention also takes advantage of existing vapor passageways in the nozzle to channel vapor to the diaphragm chamber 90, while at the same time providing continuous reference pressure from the vehicle fill pipe to ensure a reliable automatic shutoff response.

Other embodiments are within the following claims.

What is claimed is:

1. In a fuel dispensing nozzle for delivering fuel into a fuel tank by way of a fill pipe, said nozzle comprising a nozzle body, a spout housing, a spout extending from said spout housing, a fuel conduit defined by said nozzle and leading to said spout, a vapor conduit associated with said spout for withdrawing displaced vapors from the fuel tank being filled and transporting them to a remote vapor collection system, a fuel valve for controlling flow of fuel through said fuel conduit, an aspirator line having a tip located with respect to said spout so as to be in communication with the interior of the tank being filled when said spout is inserted in the fill pipe, means for producing a negative pressure in said aspirator line, pressure sensitive means in communication with said aspirator line for closing said fuel valve when a predetermined negative vent pressure condition exists in said aspirator line, an aspirator valve in said aspirator line between said tip and said means for producing a negative pressure in said aspirator line, pressure actuable means for controlling said aspirator valve, a vapor regulator valve in said vapor conduit operable in response to a predetermined first vapor pressure condition in said fuel tank, said vapor regulator valve comprising a diaphragm mounted in said nozzle with a first surface facing said vapor conduit, said diaphragm blocking said vapor conduit in a first position and not blocking said vapor conduit in a second position, and biasing means urging said diaphragm to said second position, said diaphragm having a second surface facing a chamber, said nozzle further defining a vent linking said chamber with the ambient exterior of said nozzle, the improvement wherein said pressure actuable means for controlling said aspirator valve is in communication with said vapor conduit, and said vapor regulator valve and said pressure actuable means comprise a single said diaphragm, said pressure actuable means being arranged to respond to both positive and negative vapor pressure conditions in said vapor conduit and to close said aspirator valve when either of a predetermined second negative or positive vapor pressure condition is detected in the fuel tank being filled, thereby permitting the negative pressure in said aspirator line to reach said predetermined negative vent pressure value at said pressure sensitive means so as to actuate said pressure sensitive means to close said fuel valve.

2. The fuel dispensing nozzle of claim 1 wherein said vapor regulator valve further comprises a plug defining a vapor conduit orifice, and said diaphragm is adapted to move between a first position spaced from engagement with said plug and a second position in which said diaphragm is engaged with said plug in a manner to block said orifice.

3. The fuel dispensing nozzle of claim 2 wherein said plug, in response to engagement by said diaphragm, is movable between a first position and a second position, and said nozzle further comprises biasing means urging said plug toward said first position.

4. The fuel dispensing nozzle of claim 3 wherein said biasing means for each of said diaphragm and said plug comprise a spring means, the spring means biasing said diaphragm having a lower biasing force than the biasing force of the spring means biasing said plug, whereby the absolute value of a predetermined first negative vapor pressure condition required for actuation of said vapor regulator valve to block said vapor conduit is less than the absolute value of a predetermined second negative vapor pressure condition required for actuation of said pressure actuable means.

5. The fuel dispensing nozzle of claim 4 wherein said predetermined first negative vapor pressure condition is of the order of $\frac{1}{4}$ inch W.C. below atmospheric.

6. The fuel dispensing nozzle of claim 4 wherein said aspirator valve comprises a valve housing and a valve member disposed for movement relative to said housing, and said spring means biasing said plug comprises a first spring element disposed between said valve housing and said valve member, and a second spring element disposed between said valve member and said plug.

7. The fuel dispensing nozzle of claim 6 wherein said aspirator valve further comprises a first valve seat and a second valve seat, said pressure actuable means for controlling said aspirator valve being adapted, in response to said predetermined second negative vapor pressure condition to cause said valve member to engage upon said first valve seat in a manner to restrict flow in said aspirator line, and said pressure actuable means for controlling said aspirator valve being further adapted, in response to said predetermined positive vapor pressure condition to cause said valve member to engage upon said second valve seat in a manner to restrict flow in said aspirator line.

8. The fuel dispensing nozzle of claim 7 wherein said predetermined second negative vapor pressure condition is of the order of 10 inches W.C. below atmospheric.

9. The fuel dispensing nozzle of claim 7 wherein said predetermined positive vapor pressure condition is of the order of 10 inches W.C. above atmospheric.

10. The fuel dispensing nozzle of claim 7 wherein said nozzle further comprises a stem member connecting said diaphragm and said valve member, said valve member defines an axial cavity within which an end of said stem member is disposed, and said spring means biasing said diaphragm is disposed within said cavity about said end of said stem

11. The fuel dispensing nozzle of claim 10 wherein said stem defines a collar and said spring means biasing said diaphragm is engaged between said valve member and a surface of said collar.

12. The fuel dispensing nozzle of claim 7 wherein said valve member defines an annular flange and said first and second springs for biasing said plug engage upon surfaces of said flange.

13. The fuel dispensing nozzle of claim 12 wherein said valve member further comprises a cap, and said cap defines said flange.

14. In a fuel dispensing nozzle for delivering fuel into a fuel tank by way of a fill pipe, said nozzle comprising a nozzle body, a spout housing, a spout extending from said spout housing, a fuel conduit defined by said nozzle and leading to said spout, a vapor return line associated with said spout for withdrawing displaced vapors from the fuel tank being filled and transporting them to a remote vapor collection system, a fuel valve for controlling flow of fuel through said fuel conduit, an aspirator line having a tip located with respect to said spout so as to be in communication with the interior of the tank being filled when said spout is inserted in the fill pipe, means for producing a negative pressure in said aspirator line, and pressure sensitive means in communication with said aspirator line for closing said fuel valve when a predetermined negative pressure condition exists in said aspirator line, the improvement wherein said pressure sensitive means comprises a single diaphragm having a first surface facing an aspirator line chamber in communication with said aspirator line and a second surface forming a portion of a vapor return line chamber in communication with said vapor return line in a manner whereby the pressure in said vapor return line chamber is generally the same as the pressure at the tip of said spout in the fill pipe of the vehicle fuel tank.

15. In a fuel dispensing nozzle for delivering fuel into a fuel tank by way of a fill pipe, said nozzle comprising a nozzle body, a spout housing, a spout extending from said spout housing, a fuel conduit defined by said nozzle and leading to said spout, a vapor return line associated with said spout for withdrawing displaced vapors from the fuel tank being filled and transporting them to a remote vapor collection system, a fuel valve for controlling flow of fuel through said fuel conduit, an aspirator line having a tip located with respect to said spout so as to be in communication with the interior of the tank being filled when said spout is inserted in the fill pipe, means for producing a negative pressure in said aspirator line, and pressure sensitive means in communication with said aspirator line for closing said fuel valve when a predetermined negative pressure condition exists in said aspirator line, the improvement wherein said pressure sensitive means comprises a single diaphragm having a first surface facing an aspirator line chamber in communication with said aspirator line and a second surface forming a portion of a vapor return line chamber in communication with said vapor return line in a manner whereby the pressure in said vapor return line chamber is generally the same as the pressure at the tip of said spout in the fill pipe of the vehicle fuel tank, and a bore is defined by said spout housing and intersects said aspirator line, said bore, when said spout is disposed in a predetermined position for delivery of fuel into the fuel tank fill pipe, having an axis which is inclined downwardly from the intersection of said bore and said aspirator line, said nozzle further comprises a valve element disposed in said bore, said valve element being adapted to move between a first position with said valve element spaced from the intersection of said bore and said aspirator line in a manner to allow vacuum to be drawn through said aspirator line from said spout and a second position with said valve element disposed at the intersection of said bore and said aspirator line in a manner to block the drawing of vacuum through said vapor conduit from said spout, thereby to actuate said pressure sensitive means to cause said fuel valve to close ceasing flow of fuel to said spout.

16. The fuel dispensing nozzle of claim 15 wherein said valve element is a spherical element disposed within said bore, said spherical element being sized relative to said bore to permit said spherical element to roll between said first position and said second position, and said spherical element being sized relative to said aspirator line to block vacuum flow from said spout through said aspirator line when spherical element is in said second position.

17. The fuel dispensing nozzle of claim 15 or 16 wherein the axis of said bore is downwardly inclined at about 30° to the horizontal axis when said nozzle is disposed in a predetermined position for delivery of fuel into the fuel tank fill pipe.

* * * * *

UNITED STATES PATENT AND TRADEMARK OFFICE

CERTIFICATE OF CORRECTION

PATENT NO. : 5,174,346

DATED : December 29, 1992

INVENTOR(S) : James W. Healy

It is certified that error appears in the above-identified patent and that said Letters Patent is hereby corrected as shown below:

Title page, item [56]:
References cited: U.S. Patent Document; "4,059,133" should be --4,059,135--.

Col. 4, line 28; "4.," should be --4--.

Col. 5, line 22; insert --312.)-- after "screw".

Col. 7, line 18, "12" should be --126--.

Col. 12, line 62; insert --member.-- after "stem".

Signed and Sealed this

Twenty-first Day of December, 1993

*Attest:*

Bruce Lehman

BRUCE LEHMAN

*Attesting Officer*

*Commissioner of Patents and Trademarks*